US006225958B1

(12) United States Patent
Amano et al.

(10) Patent No.: US 6,225,958 B1
(45) Date of Patent: May 1, 2001

(54) MULTIFREQUENCY ANTENNA

(75) Inventors: Takashi Amano, Soka; Hisao Iwasaki, Tama; Norimichi Chiba, Hino, all of (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/381,919

(22) PCT Filed: Jan. 27, 1999

(86) PCT No.: PCT/JP99/00335

§ 371 Date: Sep. 27, 1999

§ 102(e) Date: Sep. 27, 1999

(87) PCT Pub. No.: WO99/38227

PCT Pub. Date: Jul. 29, 1999

(30) Foreign Application Priority Data

Jan. 27, 1998 (JP) ..... 10-013704

(51) Int. Cl.[7] ..... H01Q 13/10
(52) U.S. Cl. ..... 343/767; 343/770
(58) Field of Search ..... 343/700 MS, 767, 343/768, 769, 770; H01Q 13/10

(56) References Cited

U.S. PATENT DOCUMENTS

| | | | | |
|---|---|---|---|---|
| 4,775,866 | * | 10/1988 | Shibata et al. | 343/700 MS |
| 5,337,065 | * | 8/1994 | Bonnet et al. | 343/767 |
| 5,406,292 | * | 4/1995 | Schnetzer et al. | 343/700 MS |
| 5,914,693 | * | 6/1999 | Takei et al. | 343/767 |
| 5,917,450 | * | 6/1999 | Tsunekawa et al. | 343/700 MS |

FOREIGN PATENT DOCUMENTS

| | | |
|---|---|---|
| 58-215807 | 12/1983 | (JP) . |
| 62-34811 | 2/1987 | (JP) . |
| 4-122104 | 4/1992 | (JP) . |
| 9-162634 | 6/1997 | (JP) . |
| 9-284042 | 10/1997 | (JP) . |
| 9-326628 | 12/1997 | (JP) . |
| 10-93332 | 4/1998 | (JP) . |

OTHER PUBLICATIONS

Z.D. Liu et al., "Dual–Frequency Planar Inverted–F Antenna", IEEE Transactions on Antennas and Propagation, vol. 45, No. 10, pp. 1451–1458, (1997).

(List continued on next page.)

*Primary Examiner*—Tho Phan
(74) *Attorney, Agent, or Firm*—Finnegan, Henderson, Farabow, Garrett & Dunner L.L.P.

(57) ABSTRACT

A multifrequency antenna, which may be used as a built-in antenna of a small and thin radio communication terminal, such as a mobile telephone, is able to receive radio waves of multifrequency bands without enlarging the shape thereof. The antenna is structured using a main mode resonance frequency and a high-order mode resonance frequency of a single-frequency plane antenna with a short-circuit plate. Specifically, a radiator conductor plate in an optional shape is arranged on a ground plate, and the radiator conductor plate is connected to the ground plate via the short-circuit plate. Power is supplied to the radiator conductor plate from a power-feeding source via a feeder cable. In the radiator conductor plate, a cut portion for shifting the high-order mode resonance frequency to the location at a predetermined distance from the short-circuit plate is formed, and the high-order mode resonance frequency is shifted into a desired band by this cut portion. Consequently, the multi-frequency antenna operates at least at two frequencies: the main mode resonance frequency, and at least one high-order mode resonance frequency shifted by the cut portion. Thus, a small and thin multifrequency antenna can be realized at a low cost without a concomitant increase in both the mounting area and the mounting volume of the multifrequency antenna.

19 Claims, 20 Drawing Sheets

OTHER PUBLICATIONS

S. Maci et al. "Dual–Band Slot–Loaded Patch Antenna", IEE Proc.—Microw. Antennas Propag., vol. 142, No. 3, pp. 225–232, (1995).

T. Endo et al., "Characteristics of a Microstrip Antenna with a U–Shaped Slot", The Institute of Electronics, Information and Communication Engineers, vol. 96, No. 374, pp. 7–12, (1996).

* cited by examiner

MULTIFREQUENCY ANTENNA

TECHNOLOGICAL FIELD

The present invention relates to a multifrequency antenna to be used mainly as a built-in antenna of a small and in radio communication terminal such as a mobile telephone, and more particularly to a multifrequency antenna for receiving radio waves of a plurality of desired frequency bands without enlarging the size of the communication terminal by use of high-order mode resonance frequency generated in a plane antenna with a short-circuit plate.

BACKGROUND ART

As a built-in antenna of a small and thin radio communication terminal such as a mobile telephone, a plane antenna with a short-circuit plate having a structure as shown in FIG. 18 is well known.

In FIG. 18, in a plane antenna 210 with a short-circuit plate, a radiator conductor plate 212 which is a radiator conductor is arranged on a grounded conductor plate, that is, a ground plate 211, and the radiator conductor plate 212 is connected to the ground plate 211 via a short-circuit plate 213. Power is supplied to a feeding point 212*a* on the radiator conductor plate 212 by a feeder cable 214 from a power-feeding source 215 through a hole 211*a* bored in the ground plate 211.

The plane antenna 210 with a short-circuit plate shown in FIG. 18 is known to resonate at a frequency when the length of L0 shown in the drawing is about λg/4 (λg indicates an effective wavelength).

Meanwhile, in such a plane antenna, for example, to apply this antenna to a system having 2 or more built-in radio terminals, a multifrequency antenna for receiving two or more different frequency bands together may be required.

Conventionally, as a multifrequency antenna for receiving two or more different frequency bands, the constitution shown in FIG. 19 or 20 is known.

A multifrequency antenna 220 shown in FIG. 19 is structured so that two radiator conductor plates 222-1 and 222-2 different in size are arranged in parallel with a ground plate 221, and these two radiator conductor plates 222-1 and 222-2 are connected to the ground plate 221 via short-circuit plates 223-1 and 223-2 respectively, and power is supplied to a feeding point 222-1*a* on the radiator conductor plate 222-1 from a power-feeding source 225-1 via a feeder cable 224-1, and power is supplied to a feeding point 222-2*a* on the radiator conductor plate 222-2 from a power-feeding source 225-2 via a feeder cable 224-2.

Namely, the multifrequency antenna 220 shown in FIG. 19 is structured so that two single-frequency plane antennas resonating in different frequency bands respectively are arranged side by side and by use of such a constitution, a problem arises that the arrangement of the two single-frequency plane antennas increases the mounting area. A multifrequency antenna 230 shown in FIG. 20 is structured so that two radiator conductor plates 232-1 and 232-2 different in size are stacked and arranged on a ground plate 231, and these two radiator conductor plates 232-1 and 232-2 are connected to the ground plate 231 via short-circuit plates 233-1 and 233-2 respectively, and power is supplied to a feeding point 232-1*a* on the radiator conductor plate 232-1 from a power-feeding source 235-1 via a feeder cable 234-1, and power is supplied to a feeding point 232-2*a* on the radiator conductor plate 232-2 from a power-feeding source 235-2 via a feeder cable 234-2.

Namely, the multifrequency antenna 230 shown in FIG. 20 is structured so that two single-frequency plane antennas resonating in different frequency bands respectively are stacked and arranged and by use of such a constitution, a problem arises that the stacking arrangement of the two single-frequency plane antennas increases the height of the mounting portion and increases the mounting volume.

As mentioned above, in a conventional multifrequency antenna, compared with a single-frequency plane antenna with a short-circuit plate, the mounting area and mounting volume are larger and it may cause obstacles to miniaturization and thinning of a radio terminal accommodating this multifrequency antenna.

DISCLOSURE OF THE INVENTION

An object of the present invention is to provide a small multifrequency antenna requiring no increase in mounting area and mounting volume.

The present invention constitutes a multifrequency antenna using the main mode resonance frequency and high-order mode resonance frequency of a single-frequency plane antenna with a short-circuit plate.

Generally, in a single-frequency plane antenna with a short-circuit plate having a main mode resonance frequency, there is a high-order mode resonance frequency integer times of this main mode resonance frequency. However, this high-order mode resonance frequency may be often different from a desired frequency band and cannot be used as it is.

Therefore, according to the present invention, a single-frequency plane antenna with a short-circuit plate is structured so that a cut portion is formed in a predetermined location of the radiator conductor plate thereof and a predetermined high-order mode resonance frequency is shifted to a desired frequency band by this cut portion and by doing this, both of them can be received in a plurality of desired different frequency bands.

Namely, the present invention is characterized in that a multifrequency antenna has a ground plate, a radiator conductor plate arranged opposite to the ground plate, a short-circuit plate for connecting the ground plate and radiator conductor plate, and a power supply means for supplying power to the radiator conductor plate, and the radiator conductor plate has at least one cut portion for shifting at least one high-order mode resonance frequency to a predetermined frequency, and the multifrequency antenna operates at least at two frequencies such as the main mode resonance frequency and at least one high-order mode resonance frequency shifted by the cut portion.

The cut portion is formed at least in one of the locations integer times of the distance C/2 fn (where n indicates the order of an odd-order mode (n=3, 5, 7, c a light speed, fn an n-order mode resonance frequency) from the short-circuit plate on the radiator conductor plate.

The cut portion may comprise a slot with a length of SL and a width of SW formed orthogonally to the current flowing on the radiator conductor plate.

Furthermore, the cut portion may comprise a hole in an optional shape formed on the radiator conductor plate. Furthermore, the cut portion may comprise a cut-out portion with one end open in an optional shape formed in the radiator conductor plate.

The multifrequency antenna may be structured so that the distance between the ground plate and the radiator conductor plate varies with the distance from the short-circuit plate on the radiator conductor plate.

Furthermore, the cut portion may be structured so as to be formed in the location at a predetermined distance shifted from the center on the radiator conductor plate.

Furthermore, the ground plate may be structured so as to be formed in the location at a predetermined distance shifted from the center on the radiator conductor plate.

The multifrequency antenna further has a dielectric of a predetermined dielectric constant arranged between the ground plate and the radiator conductor and the cut portion is formed at least in one of the locations integer times of the distance $C/(2 fn\sqrt{r})$(where n indicates the order of an odd-order mode (n=3, 5, 7, c a light speed, fn an n-order mode resonance frequency, $\epsilon r$ the dielectric constant of the dielectric) from the short-circuit plate on the radiator conductor plate.

In this case, the dielectric can be structured so that the dielectric constant thereof varies with the distance from the short-circuit plate on the radiator conductor plate.

Furthermore, the power supply means may be structured so as to supply power to the location at a predetermined distance shifted from the center on the radiator conductor plate.

Furthermore, the power supply means may be structured so as to include the coaxial line connected to the radiator conductor plate.

Furthermore, the power supply means may be structured so as to include the coplaner line for supplying power to the radiator conductor by electromagnetic coupling with the radiator conductor plate.

Furthermore, the power supply means may be structured so as to include the strip line or micro-strip line connected to the radiator conductor plate.

BEST MODE FOR CARRYING OUT THE INVENTION

The embodiments of a multifrequency antenna according to the present invention will be explained in detail hereunder with reference to the accompanying drawings.

Figure 1:
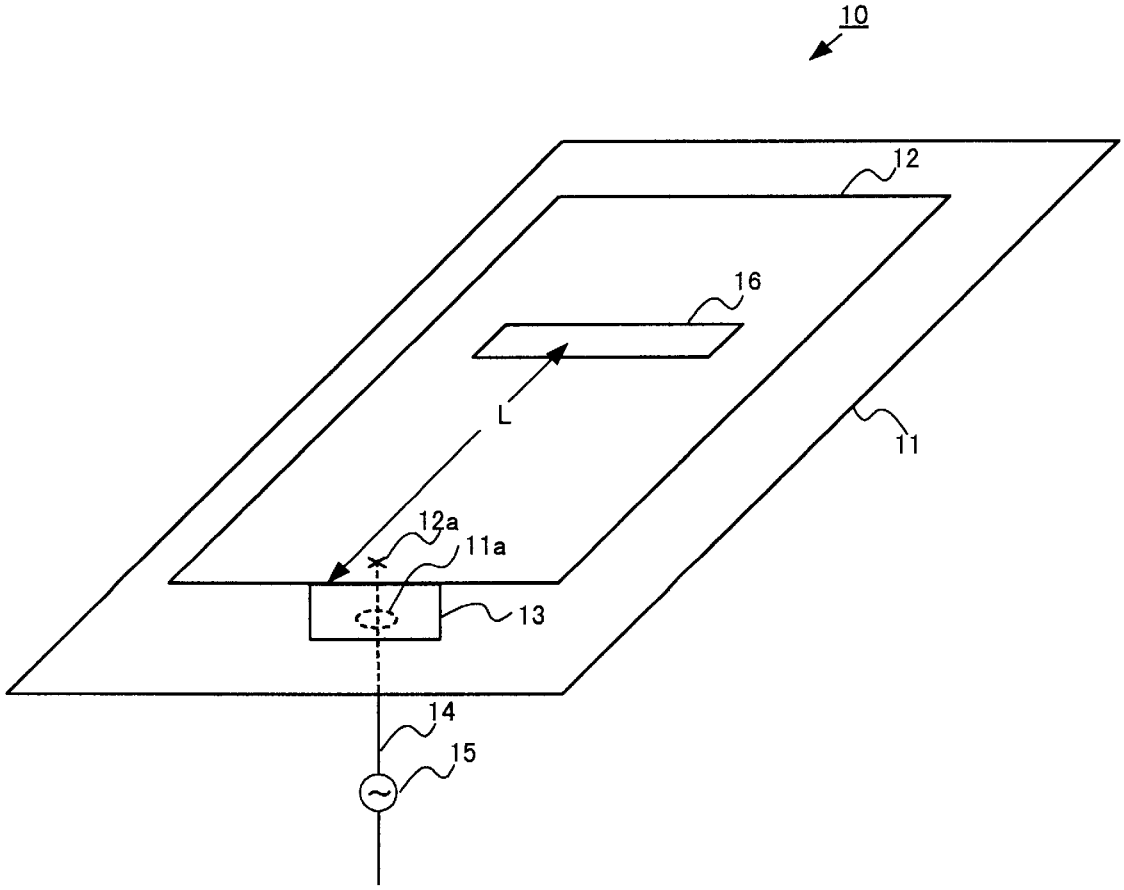
FIG. 1 is a perspective view showing the first embodiment of a multifrequency antenna according to the present invention.

FIG. 1 is a perspective view showing the first embodiment of a multifrequency antenna according to the present invention.

In FIG. 1, in a multifrequency antenna 10 of the first embodiment, a rectangular radiator conductor plate 12 which is a radiator conductor is arranged on a ground conductor plate, that is, a ground plate 11 and the radiator conductor plate 12 is connected to the ground plate 11 by a short-circuit plate 13. Power is supplied to a feeding point 12*a* on the radiator conductor plate 12 from a power-feeding source 15 by a feeder cable 14 via a hole 11*a* bored in the ground plate 11.

In the radiator conductor plate 12, a rectangular slot 16 is formed in the location at a distance of L3 from the-short-circuit plate 13. The slot 16, as described later in detail, has a frequency adjustment function for shifting the 3rd mode resonance frequency to the low frequency side like the resonance characteristic diagram shown in FIG. 2 and setting the 3rd mode resonance frequency within a desired band.

By use of such a constitution, a multifrequency antenna for receiving both radio waves in the two frequency bands such as the band of the main mode resonance frequency f0 and the band of the shifted 3rd mode resonance frequency f3' can be structured.

In this case, the multifrequency antenna 10 is just provided with the rectangular slot 16 in the radiator conductor plate 12 which is the same as that of a conventional plane antenna with a short-circuit plate, so that it is equal to a single frequency plane antenna resonating at the frequency f0 in terms of the mounting area and it is also equal to a single frequency plane antenna resonating at the frequency f0 in terms of the mounting height (volume). Therefore, compared with a conventional multifrequency antenna, miniaturization and thinning can be realized.

Figure 3:
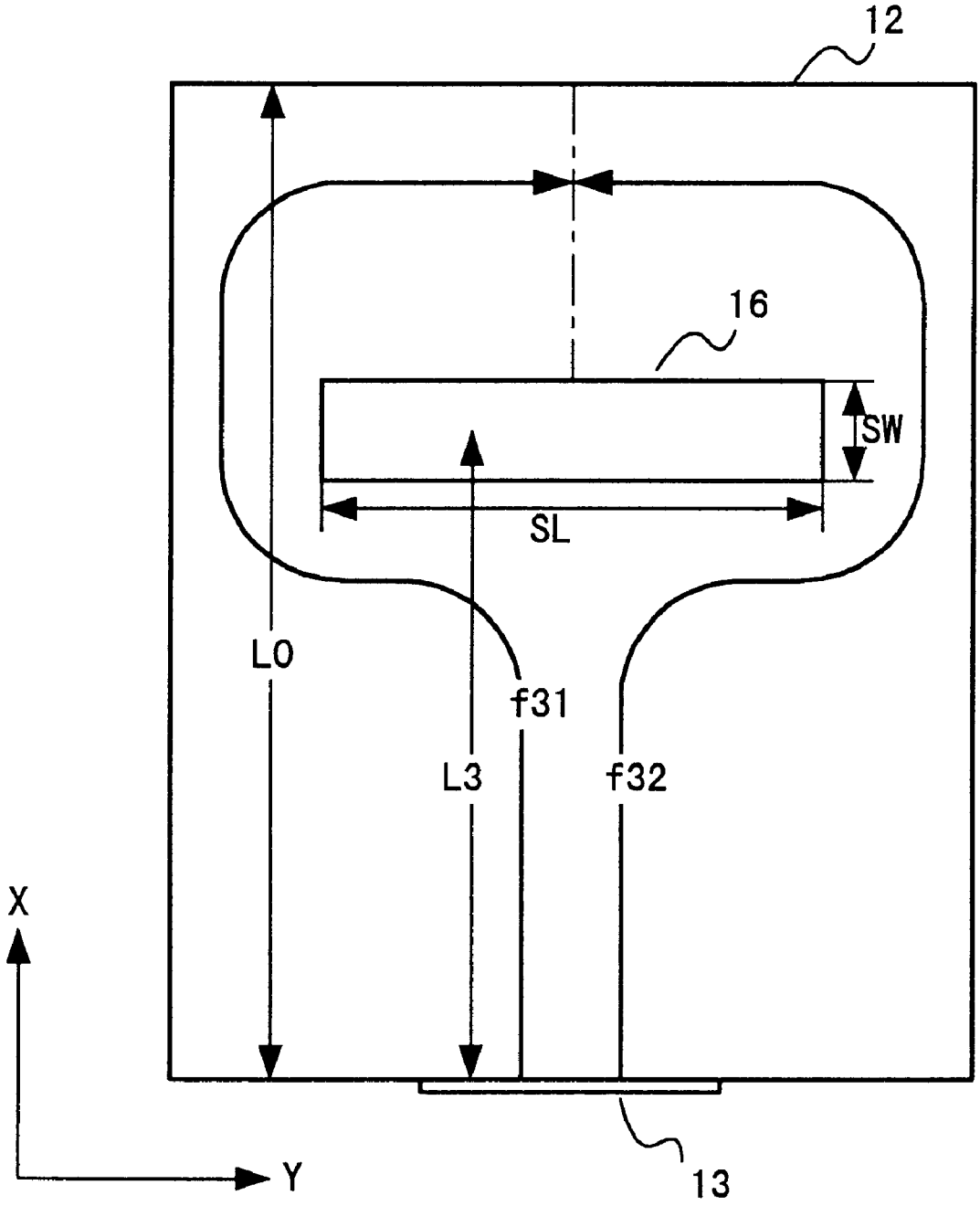
FIG. 3 is a detailed diagram of the radiator conductor plate of the multifrequency antenna shown in FIG. 1, FIGS. 4(*a*) and 4(*b*) are diagrams showing the 3rd mode electric field distribution and current distribution of the radiator conductor plate when no slot is provided in the radiator conductor plate of the multifrequency antenna shown in FIG. 1.

FIG. 3 shows the radiator conductor plate 12 of the multifrequency antenna 10 shown in FIG. 1 in detail.

In FIG. 3, the radiator conductor plate 12 of the multifrequency antenna 10 has a length of L0 in the X direction and the rectangular slot 16 with a length of SL and a width of SW is formed in the location at a distance of L3 from the short-circuit plate 13.

In this case, assuming the main mode effective wave length of the multifrequency antenna 10 as λ1 g, the length L0 of the radiator conductor plate 12 in the X direction is set at λ1 g/4.

Assuming the 3rd mode resonance frequency of the multifrequency antenna 10 as f3, the distance L3 between the short-circuit plate 13 and the slot 16 is set at:

$$L3=c/2f3$$

where c indicates the light speed.

In the aforementioned constitution, the 3rd mode current of the multifrequency antenna 10 flows like f31 and f32 shown in FIG. 3. Namely, the 3rd mode current of the multifrequency antenna 10 flows along the slot 16 formed in the radiator conductor plate 12 and by doing this, the 3rd mode resonance frequency can be shifted to the low frequency side like the resonance characteristic diagram shown in FIG. 2.

Figure 4A:
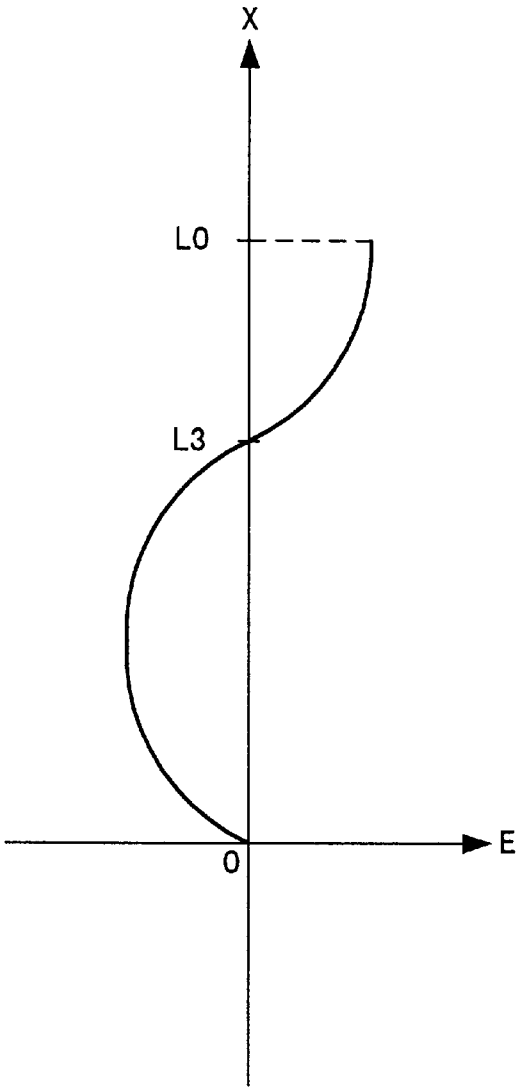
Figure 4B:
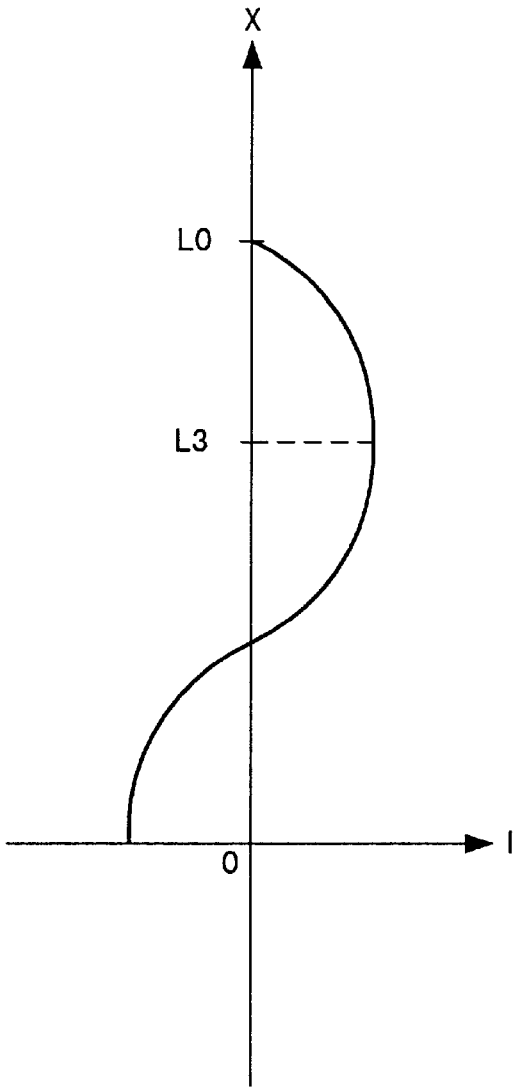

In this case, the 3rd mode electric field distribution in the radiator conductor plate 12 when the radiator conductor plate 12 of the multifrequency antenna 10 is not provided with the slot 16 may be shown as FIG. 4(*a*) and the current distribution may be shown as FIG. 4(*b*).

As clearly shown in FIGS. 4(*a*) and 4(*b*), in the multifrequency antenna 10 shown in FIGS. 1 and 3, the location where the 3rd mode current in the radiator conductor plate 12 is maximized is the location where the slot 16 is formed. Therefore, the slot 16 formed in the radiator conductor plate 12 effectively operates on the 3rd mode current of the multifrequency antenna 10 and the 3rd mode resonance frequency can be shifted to the low frequency side.

When the length SL of the slot 16 is increased, the shift amount of the 3rd mode resonance frequency increases and when the length SL of the slot 16 is decreased inversely, the shift amount of the 3rd mode resonance frequency decreases.

When the width SW of the slot 16 is increased, the bandwidth of the shifted 3rd mode resonance frequency is decreased and when the width SW of the slot 16 is decreased inversely, the bandwidth of the shifted 3rd mode resonance frequency is increased. However, unless the width SW of the slot 16 is a fixed width relating to the 3rd mode resonance frequency or more, an effective shift of the 3rd mode resonance frequency cannot be realized.

As mentioned above, in the multifrequency antenna 10 shown in FIGS. 1 and 3, when the shape of the slot 16 formed in the radiator conductor plate 12 is changed, the shift amount of the 3rd mode resonance frequency and the bandwidth of the shifted 3rd mode resonance frequency can be adjusted and by doing this, when the 3rd mode resonance frequency is shifted to a desired band, a multifrequency antenna for receiving radio waves both in two frequency bands such as the band of the main mode resonance frequency and the band of the shifted 3rd mode resonance frequency can be structured.

Figure 5:
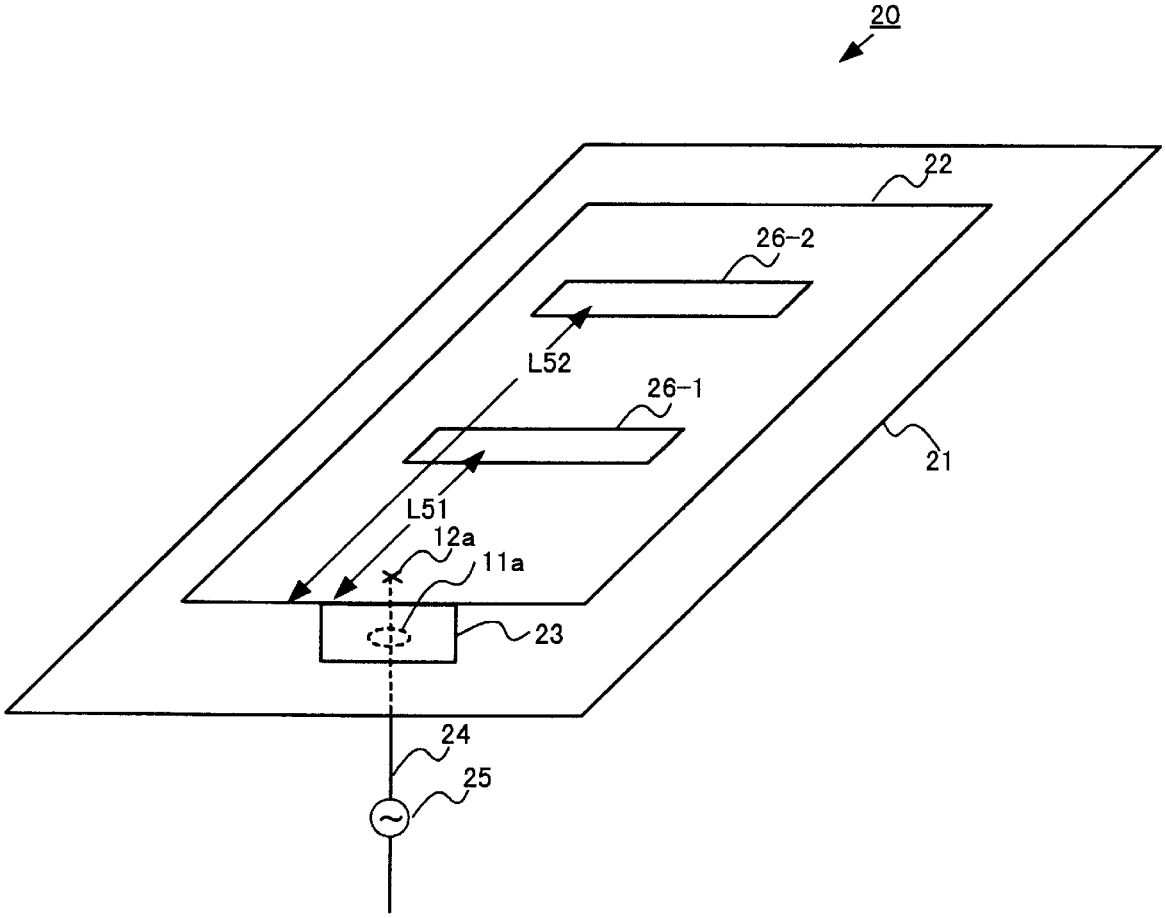
FIG. 5 is a perspective view showing the second embodiment of a multifrequency antenna according to the present invention.

FIG. 5 is a perspective view showing the second embodiment of a multifrequency antenna according to the present invention.

The multifrequency antenna shown in FIG. 5 can receive radio waves both in two different frequency bands using the 5th mode resonance frequency in addition to the main mode resonance frequency.

In FIG. 5, in a multifrequency antenna 20, a rectangular radiator conductor plate 22 which is a radiator conductor is arranged on a ground plate 21 which is grounded and the radiator conductor plate 22 is connected to the ground plate 21 via a short-circuit plate 23. Power is supplied to a feeding point 22*a* on the radiator conductor plate 22 by a feeder cable 24 from a power-feeding source 25 via a hole 21*a* bored in the ground plate 21.

In the radiator conductor plate 22, a rectangular first slot 26-1 is formed in the location at a distance of L51 from the short-circuit plate 23 and a rectangular second slot 26-2 is formed in the location at a distance of L52 from the short-circuit plate 23.

The first slot 26-1 and the second slot 26-2 have a frequency adjustment function for shifting the 5th mode resonance frequency as explained later in detail.

By use of such a constitution, a multifrequency antenna for receiving radio waves in both two frequency bands such as the band of the main mode resonance frequency and the band of the 5th mode resonance frequency shifted by the first slot 26-1 and the second slot 26-2 can be structured.

Figure 6:
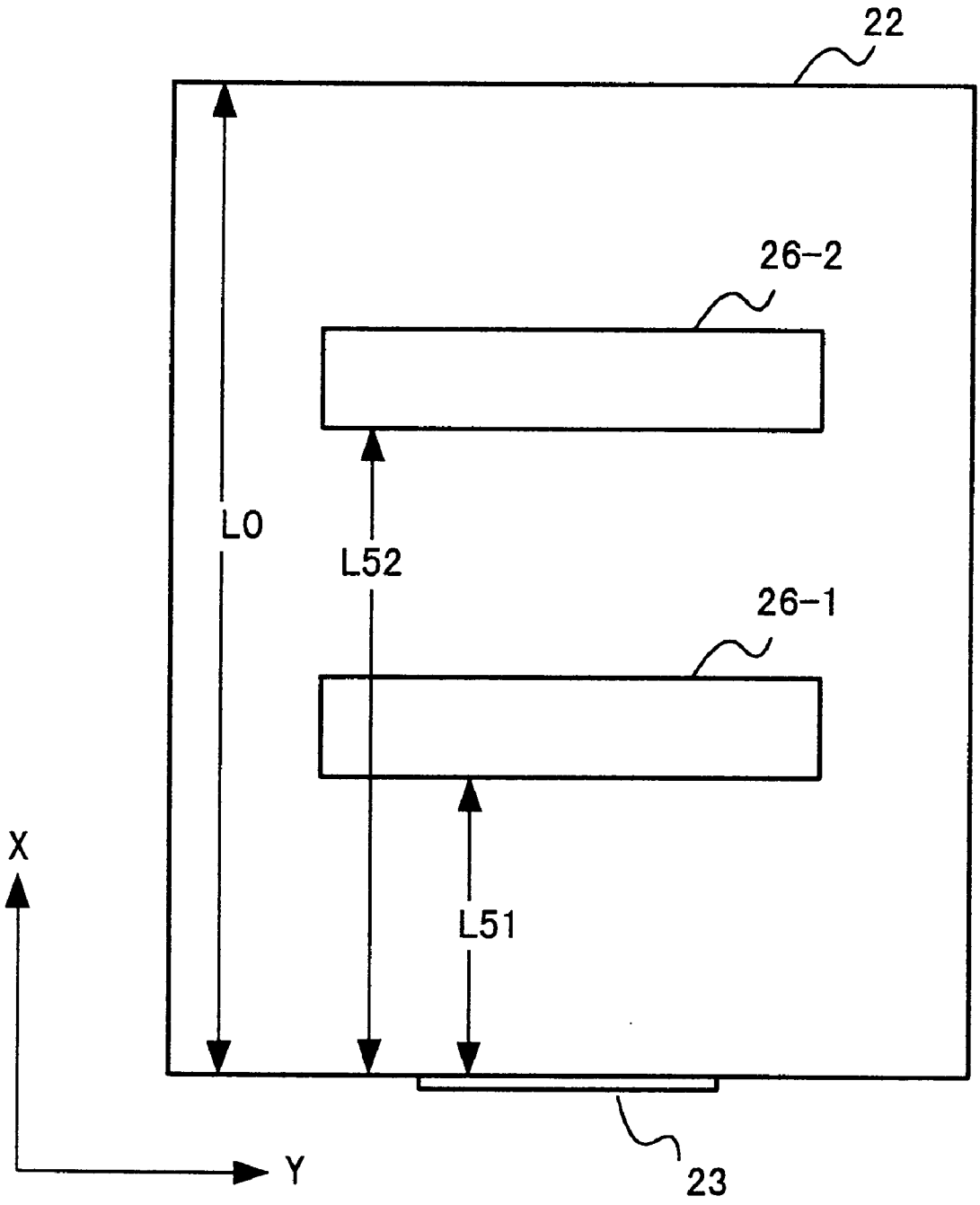
FIG. 6 is a detailed diagram of the radiator conductor plate of the multifrequency antenna shown in FIG. 5, FIGS. 7(*a*) and 7(*b*) are diagrams showing the 5th mode electric field distribution and current distribution of the radiator conductor plate when no slot is provided in the radiator conductor plate of the multifrequency antenna shown in FIG. 5.

FIG. 6 shows the radiator conductor plate 22 of the multifrequency antenna 20 shown in FIG. 5 in detail.

In FIG. 6, the radiator conductor plate 22 of the multifrequency antenna 20 has a length of L0 in the X direction, and the first slot 26-1 is formed in the location at a distance of L51 from the short-circuit plate 23, and the second slot 26-2 is formed in the location at a distance of L52 from the short-circuit plate 23.

In this case, assuming the main mode effective wave length of the multifrequency antenna 20 as λ1 g, the length L0 of the radiator conductor plate 22 in the X direction is set at λ1 g4.

Assuming the 5th mode resonance frequency of the multifrequency antenna 20 as f5, the distance L51 between the short-circuit plate 23 and the first slot 26-1 is set at:

$$L51=c/2f5$$

where c indicates the light speed and the distance L52 between the short-circuit plate 23 and the second slot 26-2 is set at:

$$L52=2c/2f5$$

where c indicates the light speed.

Figure 7A:
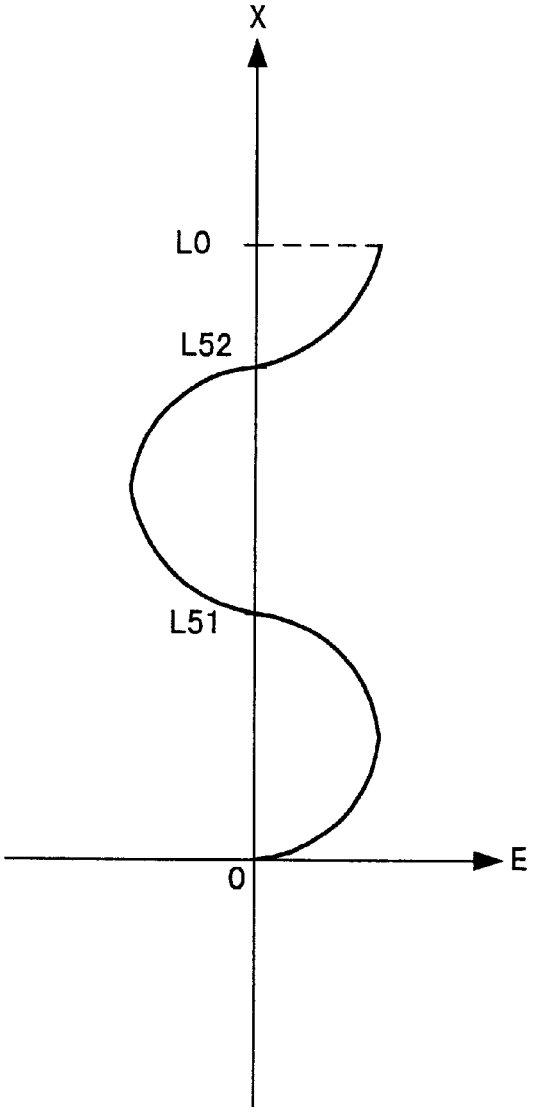
Figure 7B:
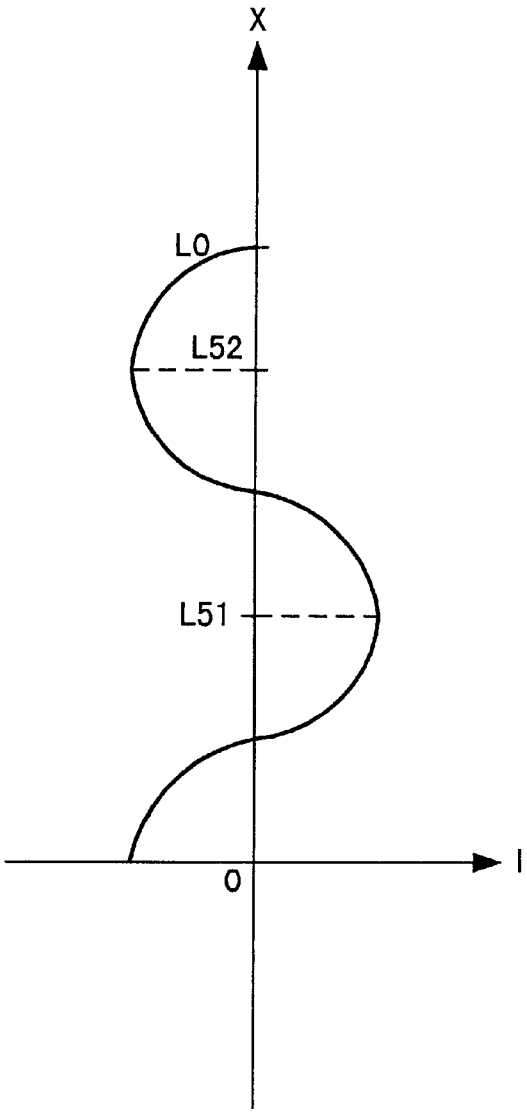

In this case, the 5th mode electric field distribution in the radiator conductor plate 22 when the first slot 26-1 and the second slot 26-2 are not provided in the radiator conductor plate 22 of the multifrequency antenna 20 may be shown as FIG. 7(*a*) and the current distribution may be shown as FIG. 7(*b*).

As clearly shown in FIGS. 7(*a*) and 7(*b*), in the multifrequency antenna 20 shown in FIGS. 5 and 6, the two locations where the 5th mode current in the radiator conductor plate 22 is maximized are the locations where the first slot 26-1 and the second slot 26-2 are formed respectively.

Therefore, the first slot 26-1 and the second slot 26-2 formed in the radiator conductor plate 22 effectively operate on the 5th mode current of the multifrequency antenna 10 and the 5th mode resonance frequency can be effectively shifted to the low frequency side.

In the aforementioned embodiments, the cut portion(s) formed in the radiator conductor plate 12 or 22 is (are) the rectangular slot 16 or the rectangular slots 26-1 and 26-2. However, the cut portion(s) may be formed in any shape other than a rectangle.

Figure 8:
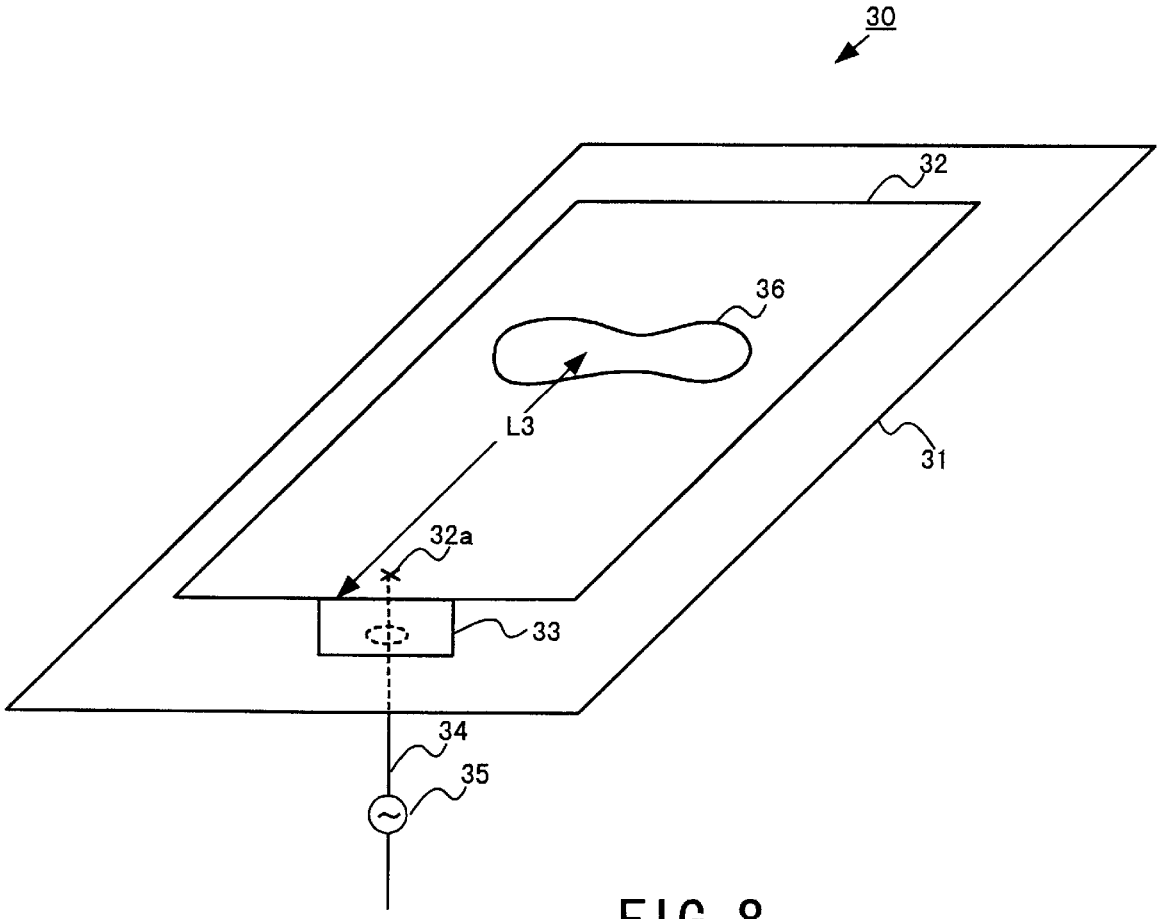
FIG. 8 is a perspective view showing the third embodiment of a multifrequency antenna according to the present invention.

FIG. 8 is a perspective view showing the third embodiment of a multifrequency antenna according to the present invention.

In a multifrequency antenna 30 in the third embodiment, the cut portion formed in a radiator conductor plate 32 has a shape enclosed by a curve.

Namely, in FIG. 8, in the multifrequency antenna 30 of the third embodiment, a rectangular radiator conductor plate 32 which is a radiator conductor is arranged on a ground plate 31 which is grounded and the radiator conductor plate 32 is connected to the ground plate 31 via a short-circuit plate 33. Power is supplied to a feeding point 32*a* on the radiator conductor plate 32 by a feeder cable 34 from a power-feeding source 35.

In the radiator conductor plate 32, a cut portion 36 in a shape enclosed by a curve is formed in the location at a distance of L3 from the short-circuit plate 33. The cut portion 36 in a shape enclosed by a curve has a frequency adjustment function for shifting the 3rd mode resonance frequency into a desired band of the 3rd mode resonance frequency in the same way as with the slot 16 of the first embodiment shown in FIG. 1 or 3.

Figure 2:
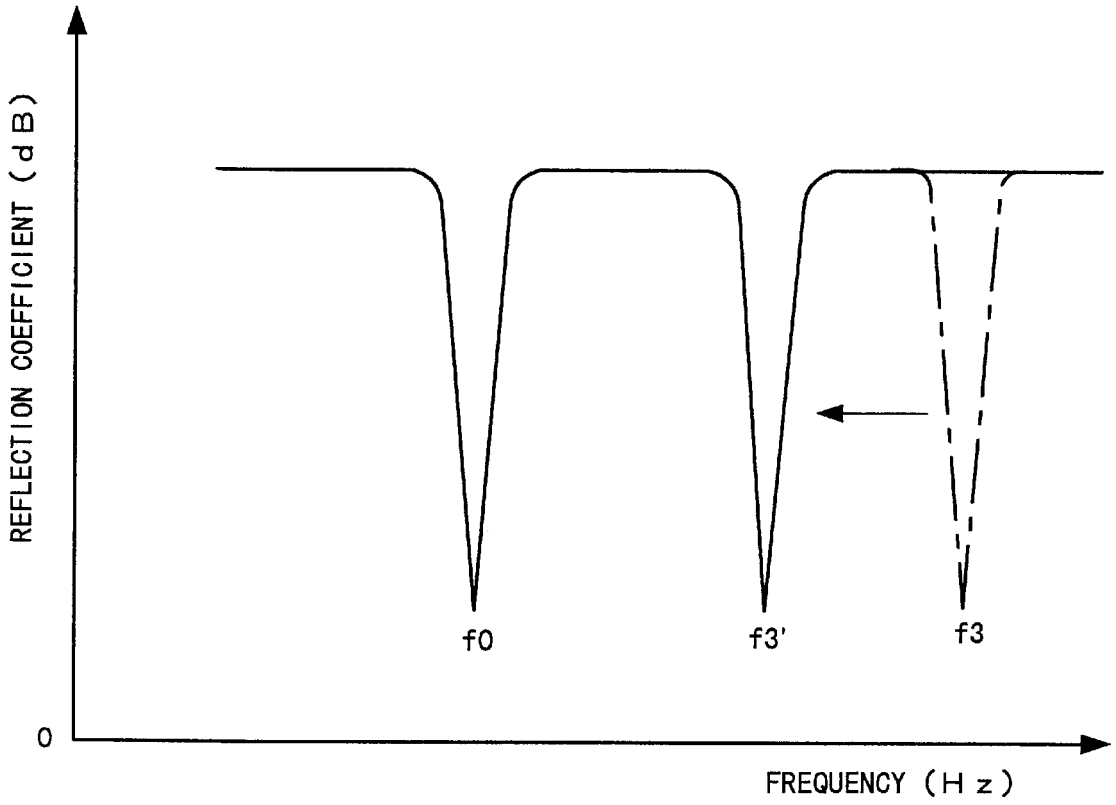
FIG. 2 is a resonance characteristic diagram of the multifrequency antenna shown in FIG. 1.

Namely, in the aforementioned constitution, the 3rd mode current of the multifrequency antenna 30 flows along the periphery of the cut portion 36 in a shape enclosed by a curve formed in the radiator conductor plate 32 and by doing this, the 3rd mode resonance frequency can be shifted to the low frequency side like the resonance characteristic diagram shown in FIG. 2. In this case, the shift amount of the 3rd mode resonance frequency and the bandwidth of the shifted 3rd mode resonance frequency can be controlled by the shape of the cut portion 36.

Figure 9:
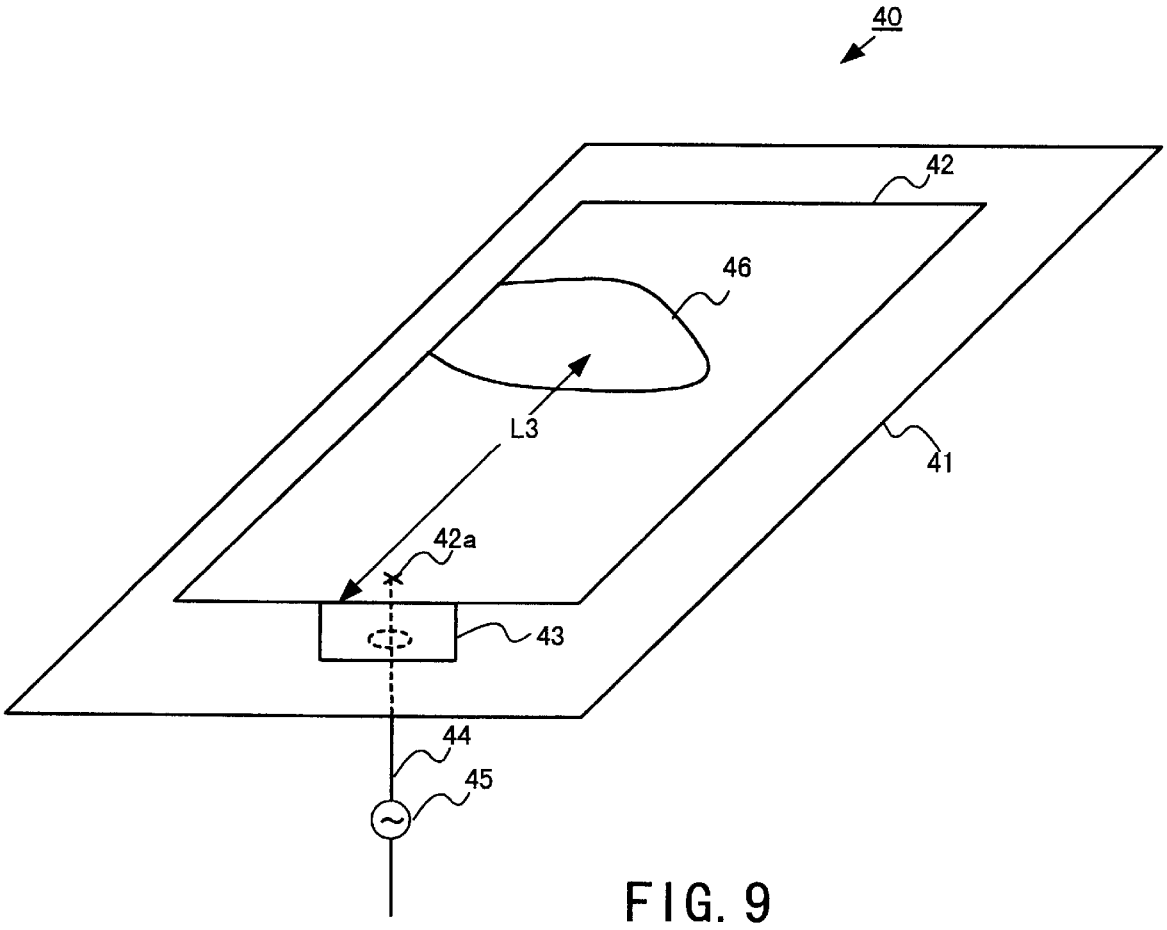
FIG. 9 is a perspective view showing the fourth embodiment of a multifrequency antenna according to the present invention.

FIG. 9 is a perspective view showing the fourth embodiment of a multifrequency antenna according to the present invention.

In a multifrequency antenna 40 in the fourth embodiment, the cut portion formed in a radiator conductor plate 42 has a shape enclosed by a curve with one end open.

Namely, in FIG. 9, in the multifrequency antenna 40 of the fourth embodiment, a rectangular radiator conductor plate 42 which is a radiator conductor is arranged on a ground plate 41 which is grounded and the radiator conductor plate 42 is connected to the ground plate 41 via a short-circuit plate 43. Power is supplied to a feeding point 42*a* on the radiator conductor plate 42 by a feeder cable 44 from a power-feeding source 45.

In the radiator conductor plate 42, a cut portion 46 in a shape enclosed by a curve with one end open is formed in the location at a distance of L3 from the short-circuit plate 43. The cut portion 46 in a shape enclosed by a curve with one end open also has a frequency adjustment function for shifting the 3rd mode resonance frequency into a desired band of the 3rd mode resonance frequency in the same way as with the slot 16 of the first embodiment shown in FIG. 1 or 3.

Namely, in the aforementioned constitution, the 3rd mode current of the multifrequency antenna 40 flows along the periphery of the cut portion 46 in a shape enclosed by a curve with one end open formed in the radiator conductor plate 42 and by doing this, the 3rd mode resonance frequency can be shifted to the low frequency side like the resonance characteristic diagram shown in FIG. 2. Also in this constitution, the shift amount of the 3rd mode resonance frequency and the bandwidth of the shifted 3rd mode resonance frequency can be controlled by the shape of the cut portion 46.

As indicated in the aforementioned third and fourth embodiments, the cut portion formed in the radiator conductor plate of the multifrequency antenna of the present invention can use not only the rectangle but also an optional shape.

Figure 10:
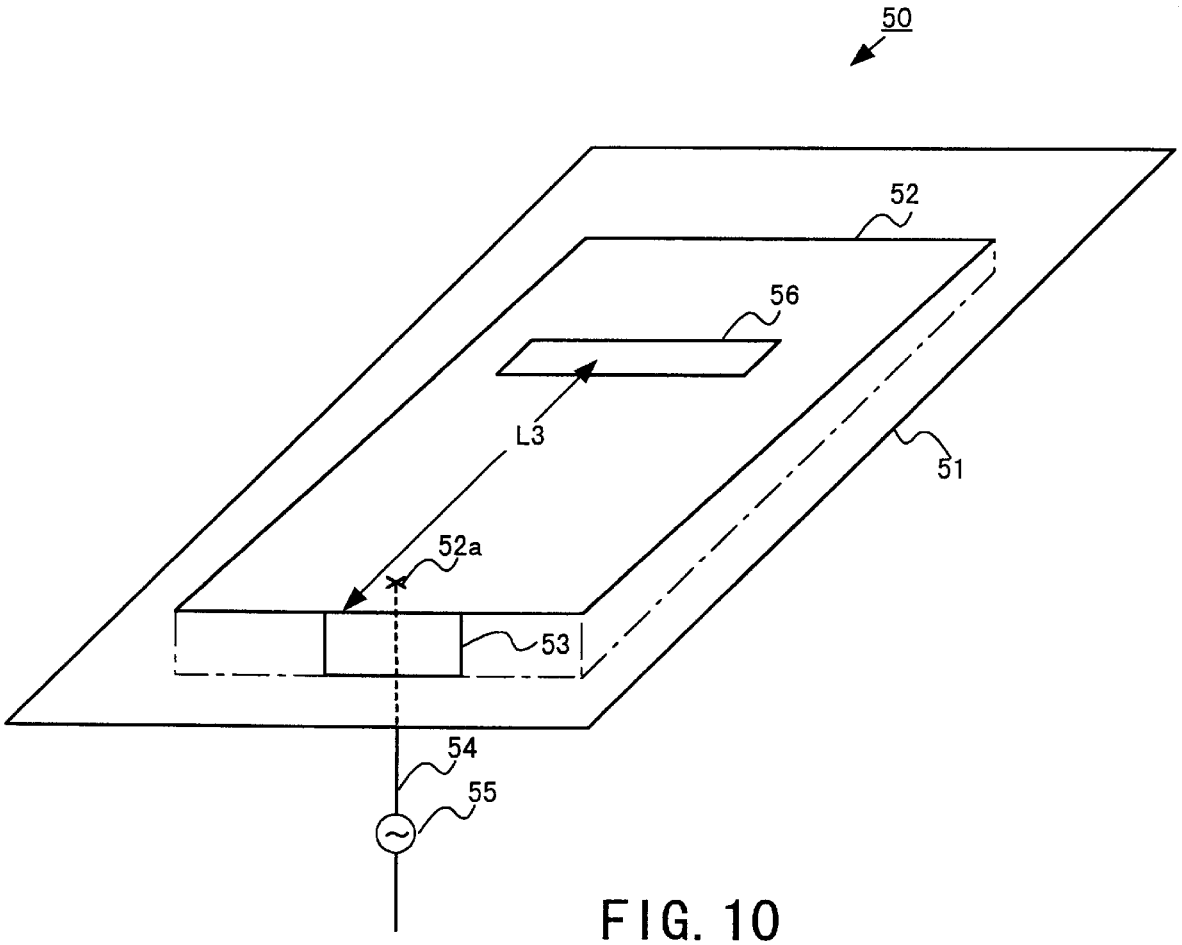
FIG. 10 is a perspective view showing the fifth embodiment of a multifrequency antenna according to the present invention.

FIG. 10 is a perspective view showing the fifth embodiment of a multifrequency antenna according to the present invention.

In a multifrequency antenna 50 of the fifth embodiment, a radiator conductor plate 52 is arranged so that the distance between the radiator conductor plate 52 and a ground plate 51 becomes shorter as the radiator conductor plate 52 separates from a short-circuit plate 53.

Namely, in FIG. 10, in the multifrequency antenna 50 of the fifth embodiment, the rectangular radiator conductor plate 52 which is a radiator conductor is arranged on the ground plate 51 which is grounded so that the distance between the radiator conductor plate 52 and the ground plate 51 becomes shorter as the radiator conductor plate 52 separates from the short-circuit plate 53 and the radiator conductor plate 52 is connected to the ground plate 51 via the short-circuit plate 53. Power is supplied to a feeding point 52*a* on the radiator conductor plate 52 by a feeder cable 54 from a power-feeding source 55.

In the radiator conductor plate 52, a slot 56 is formed in the location at a distance of L3 from the short-circuit plate 53. The slot 56 also has a frequency adjustment function for shifting the 3rd mode resonance frequency into a desired band of the 3rd mode resonance frequency in the same way as with the slot 16 of the first embodiment shown in FIG. 1 or 3.

In the aforementioned constitution, when the distance (interval) between the ground plate 51 and the radiator conductor plate 52 is changed, the capacity between the ground plate 51 and the radiator conductor plate 52 is changed and by use of it, the resonance frequency, bandwidth, and input impedance of the multifrequency antenna 50 can be adjusted.

Figure 11:
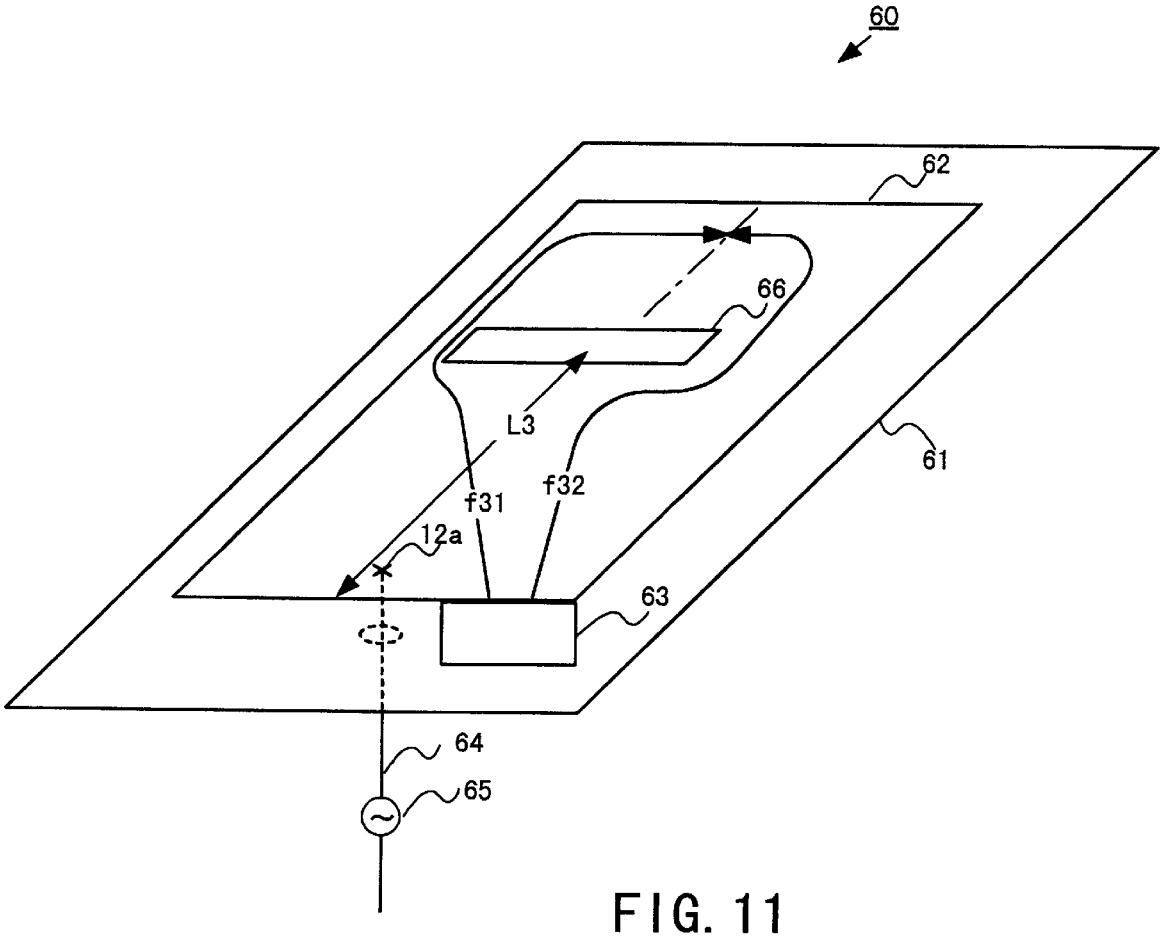
FIG. 11 is a perspective view showing the sixth embodiment of a multifrequency antenna according to the present invention.

FIG. 11 is a perspective view showing the sixth embodiment of a multifrequency antenna according to the present invention.

In a multifrequency antenna 60 of the sixth embodiment, a slot 66 to be formed in a radiator conductor plate 62 is formed in the location at a predetermined distance from the center of the radiator conductor plate 62.

A short-circuit plate 63 is also arranged in the location at a predetermined distance from the center of the radiator conductor plate 62.

Namely, in FIG. 11, in the multifrequency antenna 60 of the sixth embodiment, a rectangular radiator conductor plate 62 which is a radiator conductor is arranged on a ground plate 61 which is grounded and the radiator conductor plate 62 is connected to the ground plate 61 via a short-circuit plate 63. Power is supplied to a feeding point 62*a* on the radiator conductor plate 62 by a feeder cable 64 from a power-feeding source 65.

In the radiator conductor plate 62, the slot 66 for shifting the 3rd mode resonance frequency to the location at a distance of L3 from the short-circuit 63 is formed and the slot 66 is formed in the location at a predetermined distance from the center of the radiator conductor plate 62 in the width direction.

The short-circuit plate 63 is also arranged in the location at a predetermined distance from the center of the radiator conductor plate 62, for example, in the sixth embodiment, in the location of the end of the radiator conductor plate 62.

In this constitution, when the slot 66 to be formed in the radiator conductor plate 62 is shifted by a predetermined distance from the center of the radiator conductor plate 62 in the width direction, as shown in FIG. 11, the counterclockwise current path f31 and the clockwise current path f32 for the slot 66 are different in length and hence the band of the shifted 3rd resonance frequency can be widened.

When the short-circuit plate 63 is shifted by a predetermined distance from the center of the radiator conductor plate 62, the current paths f31 and f32 formed on the radiator conductor plate 62 are made longer and hence miniaturization of a multifrequency antenna is made possible.

Figure 12:
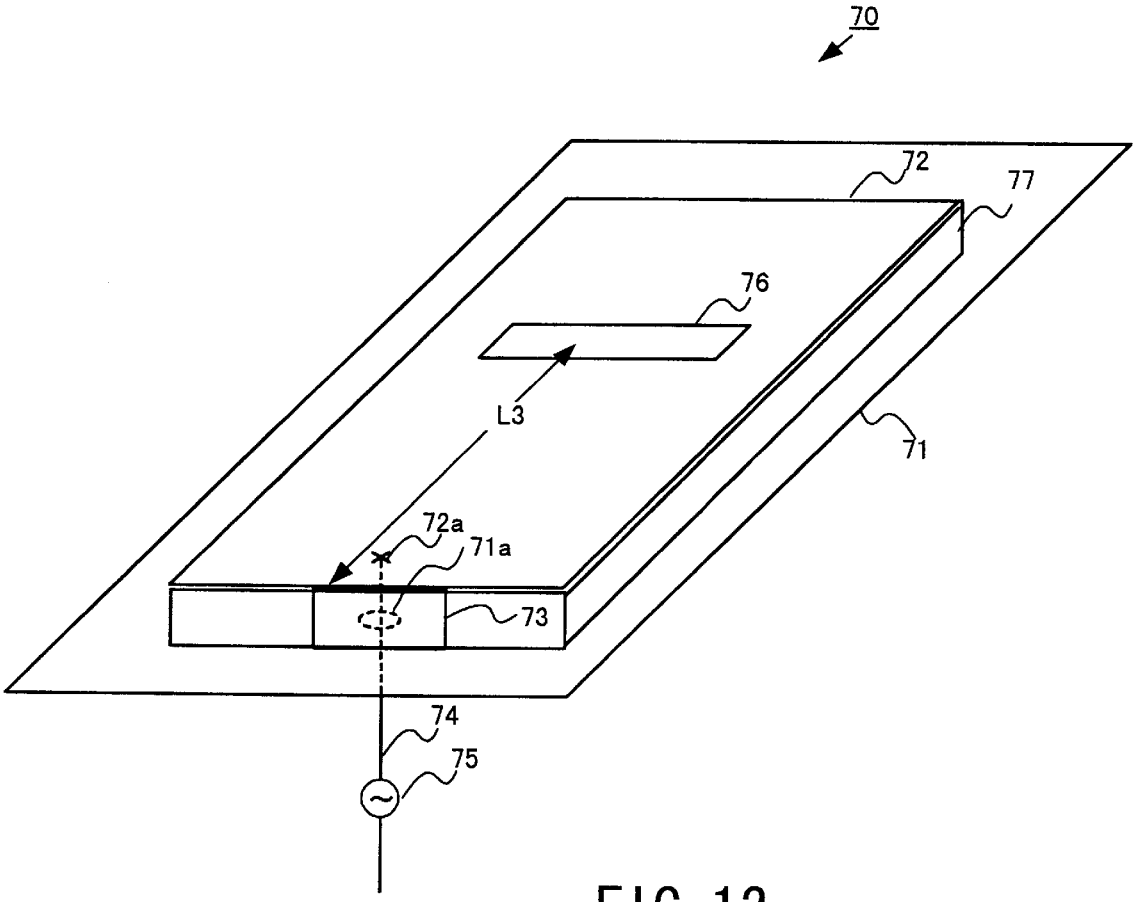
FIG. 12 is a perspective view showing the seventh embodiment of a multifrequency antenna according to the present invention.

FIG. 12 is a perspective view showing the seventh embodiment of a multifrequency antenna according to the present invention.

In a multifrequency antenna 70 of the seventh embodiment, a dielectric 77 having a predetermined dielectric constant is inserted between a radiator conductor plate 72 and a ground plate 71.

Namely, in FIG. 12, in the multifrequency antenna 70 of the seventh embodiment, a rectangular radiator conductor plate 72 which is a radiator conductor is arranged on a ground plate 71 which is grounded and the dielectric 77 having a predetermined dielectric constant is inserted between the radiator conductor plate 72 and the ground plate 71. The radiator conductor plate 72 is connected to the ground plate 71 via a short-circuit plate 73. Power is supplied to a feeding point 72*a* on the radiator conductor plate 72 by a feeder cable 74 from a power-feeding source 75 via a hole 71*a* bored in the ground plate 71.

In the radiator conductor plate 72, a slot 76 is formed in the location at a distance of L3× from the short-circuit plate 73. The slot 76 also has a frequency adjustment function for shifting the 3rd mode resonance frequency into a desired band of the 3rd mode resonance frequency in the same way as with the slot 16 of the first embodiment shown in FIG. 1 or 3.

In the seventh embodiment, the dielectric 77 having a predetermined dielectric constant is inserted between the radiator conductor plate 72 and the ground plate 71, so that assuming the 3rd mode resonance frequency of the multifrequency antenna 70 as f3 and the dielectric constant of the dielectric 77 as $\epsilon r$, the distance L3× from the short-circuit 73 to the slot 76 is set to:

$$L3\times=C/(2f3\sqrt{r})$$

where c indicates the light speed.

In the multifrequency antenna 70 of the seventh embodiment, when the dielectric 77 is inserted, the shape of an antenna can be more miniaturized and thinned.

Figure 13:
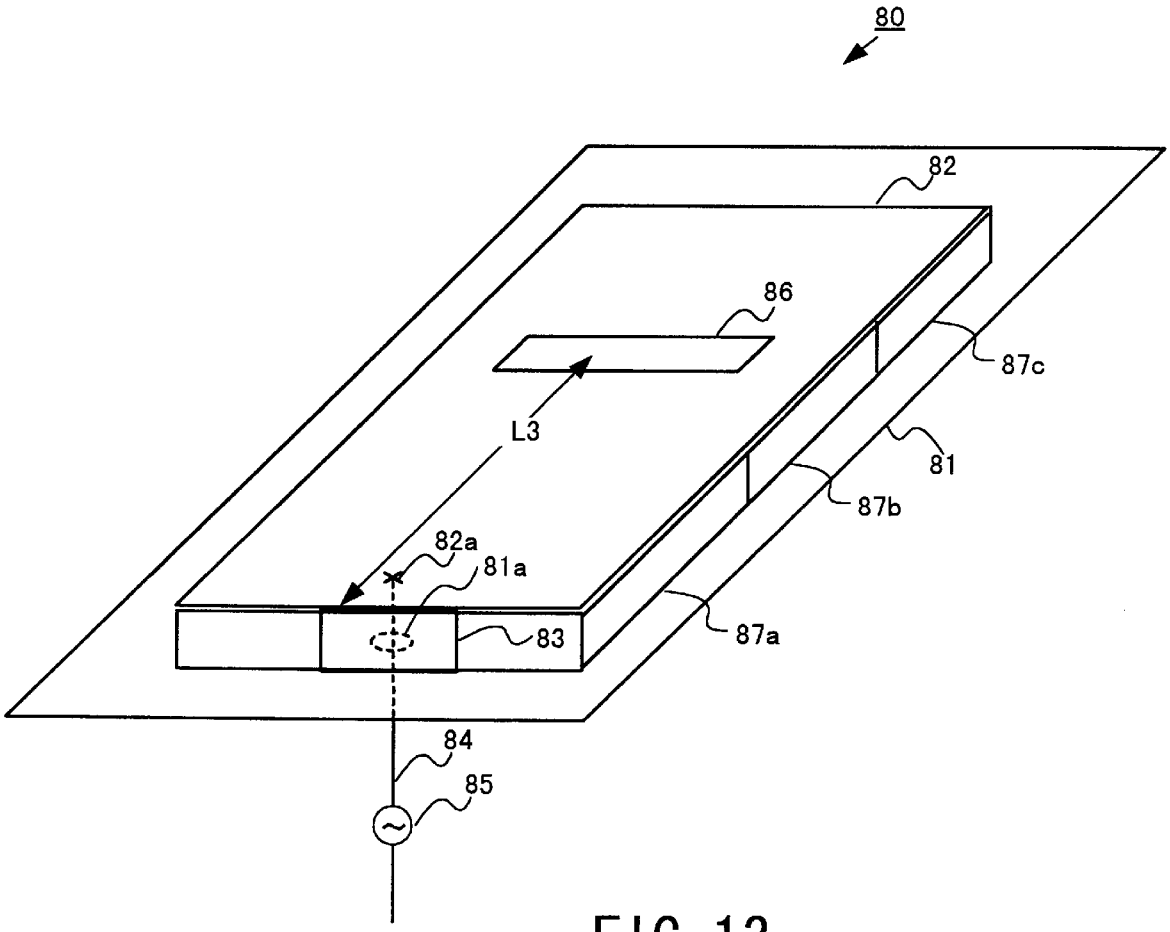
FIG. 13 is a perspective view showing the eighth embodiment of a multifrequency antenna according to the present invention.

FIG. 13 is a perspective view showing the eighth embodiment of a multifrequency antenna according to the present invention.

In a multifrequency antenna 80 of the eighth embodiment, dielectrics 87*a*, 87*b*, and 87*c* having different dielectric constants respectively are inserted between a radiator conductor plate 82 and a ground plate 81.

By use of such a constitution, the capacity between a ground plate 81 and a radiator conductor plate 82 can be changed, for example, stepwise and by use of it, the resonance frequency, bandwidth, and input impedance of the multifrequency antenna 80 can be adjusted.

Figure 14:
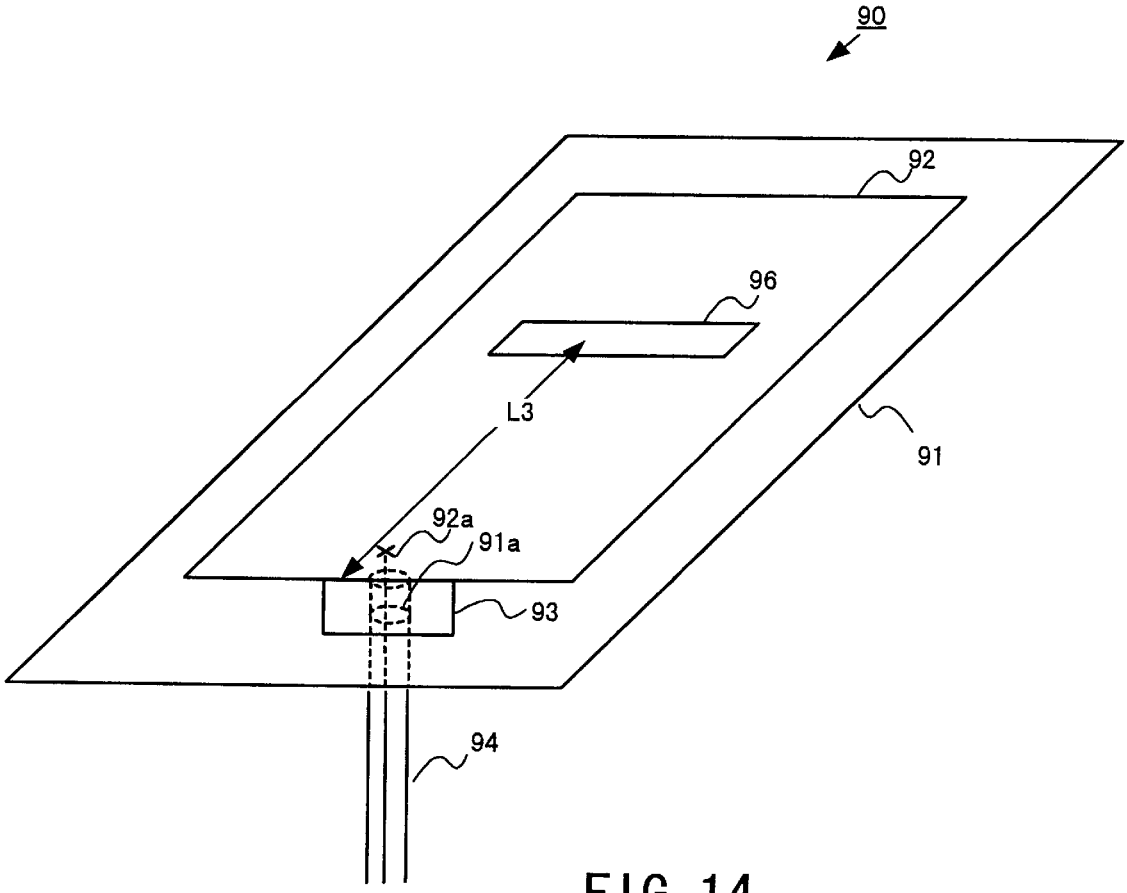
FIG. 14 is a perspective view showing the ninth embodiment of a multifrequency antenna according to the present invention and a perspective view showing the fourth embodiment of a multifrequency inverse F antenna according to the present invention.

FIG. 14 is a perspective view showing the ninth embodiment of a multifrequency antenna according to the present invention.

In a multifrequency antenna 90 of the ninth embodiment, power is supplied to a feeding point 92*a* of a radiator conductor plate 92 using a coaxial line 94.

Namely, in FIG. 14, in the multifrequency antenna 90 of the ninth embodiment, a rectangular radiator conductor plate 92 which is a radiator conductor is arranged on a ground plate 91 which is grounded and the radiator conductor plate 92 is connected to the ground plate 91 via a short-circuit plate 93.

Power is supplied to a feeding point 92*a* on the radiator conductor plate 92 by the coaxial line 94 via a hole 91*a* bored in the ground plate 71.

In the radiator conductor plate 92, a slot 96 for shifting the 3rd mode resonance frequency to the location at a distance of L3 from the short-circuit 93 is formed.

Figure 15:
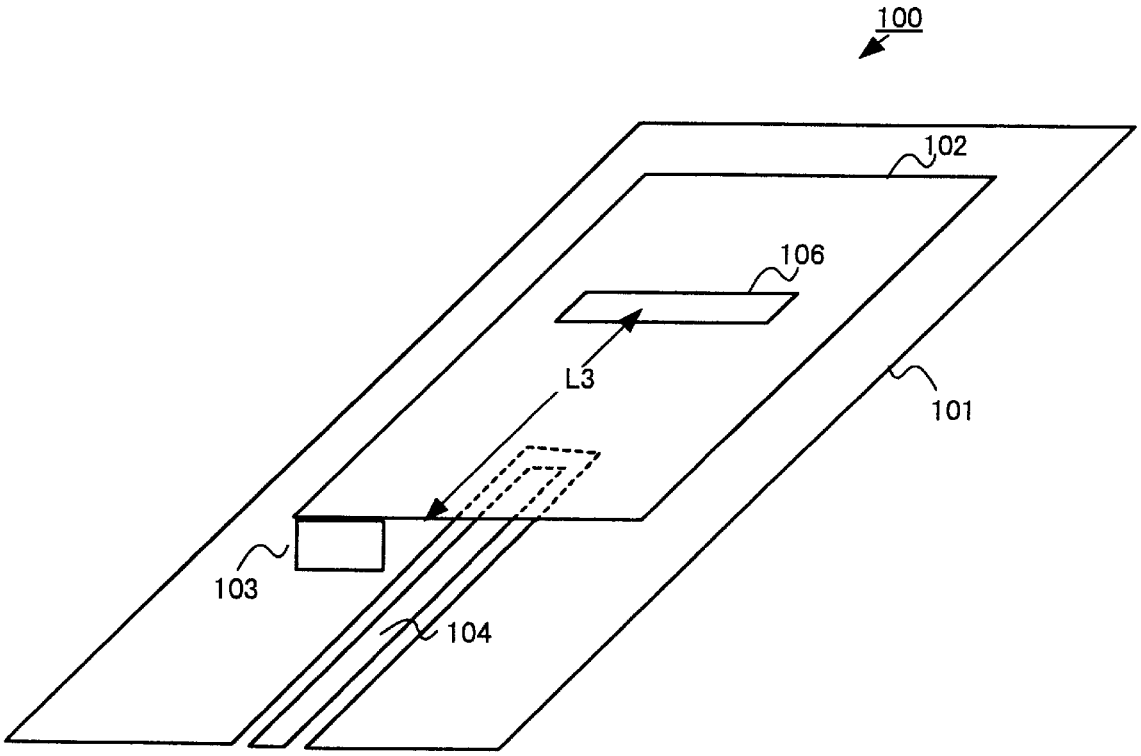
FIG. 15 is a perspective view showing the tenth embodiment of a multifrequency antenna according to the present invention.

FIG. 15 is a perspective view showing the tenth embodiment of a multifrequency antenna according to the present invention.

In a multifrequency antenna 100 of the tenth embodiment, power is supplied to a radiator conductor plate 102 using a coplanor line 104.

Namely, in FIG. 15, in the multifrequency antenna 100 of the tenth embodiment, a rectangular radiator conductor plate 102 which is a radiator conductor is arranged on a ground plate 101 which is grounded and the radiator conductor plate 102 is connected to the ground plate 101 via a short-circuit plate 103. Power is supplied to the radiator conductor plate 102 by electromagnetic coupling by the coplanor line 104 formed on the ground plate 101.

In the radiator conductor plate 102, a slot 106 for shifting the 3rd mode resonance frequency to the location at a distance of L3 from the short-circuit 103 is formed.

Figure 16:
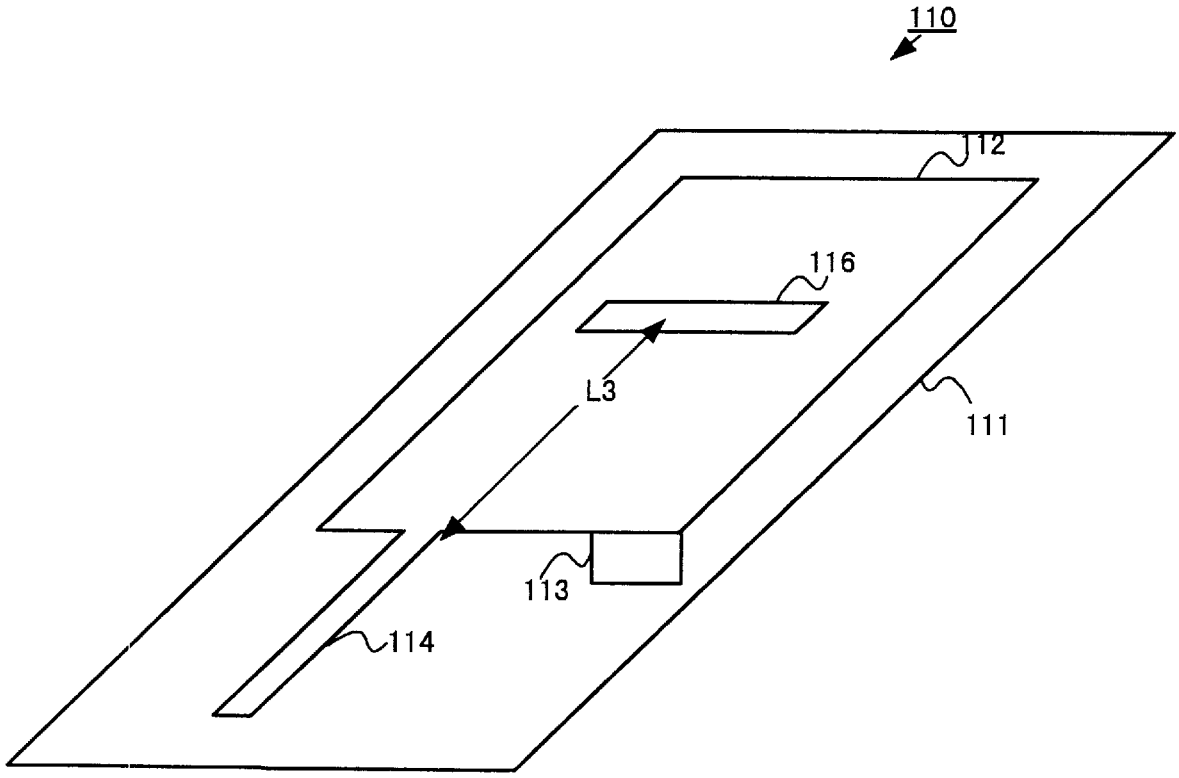
FIG. 16 is a perspective view showing the- eleventh embodiment of a multifrequency antenna according to the present invention.

FIG. 16 is a perspective view showing the eleventh embodiment of a multifrequency antenna according to the present invention.

In a multifrequency antenna 110 of the eleventh embodiment, power is supplied to a radiator conductor plate 112 using a strip line 114.

Namely, in FIG. 16, in the multifrequency antenna 110 of the eleventh embodiment, the rectangular radiator conductor plate 112 which is a radiator conductor is arranged on a ground plate 111 which is grounded and the radiator conductor plate 112 is connected to the ground plate 111 via a short-circuit plate 113. Power is supplied to the radiator conductor plate 112 by the strip line 114 connected to the radiator conductor plate 112.

In the radiator conductor plate 112, a slot 116 for shifting the 3rd mode resonance frequency to the location at a distance of L3 from the short-circuit 113 is formed.

Also by use of a microstrip line in place of the strip line 114, the same constitution may be obtained.

The location of the feeding point on the radiator conductor plate is not limited to the center position of the radiator conductor plate in the Width direction but may be the location at a predetermined distance from this center position.

By use of such a constitution, adjustment of the position of the feeding point allows matching with a transmission-reception circuit using this multifrequency antenna which is not shown in the drawing.

Figure 17:
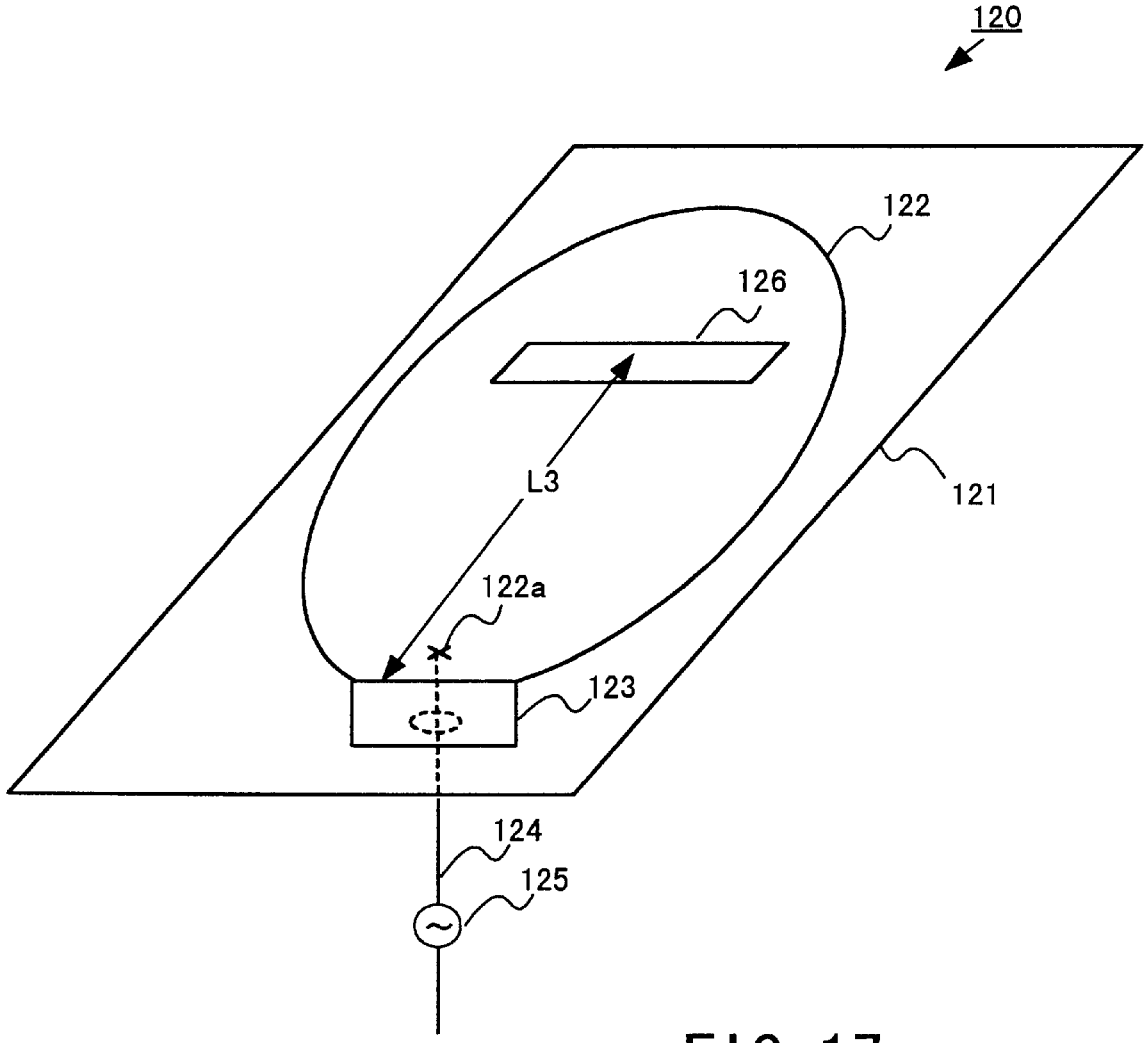
FIG. 17 is a perspective view showing the twelfth embodiment of a multifrequency antenna according to the present invention.
Figure 18:
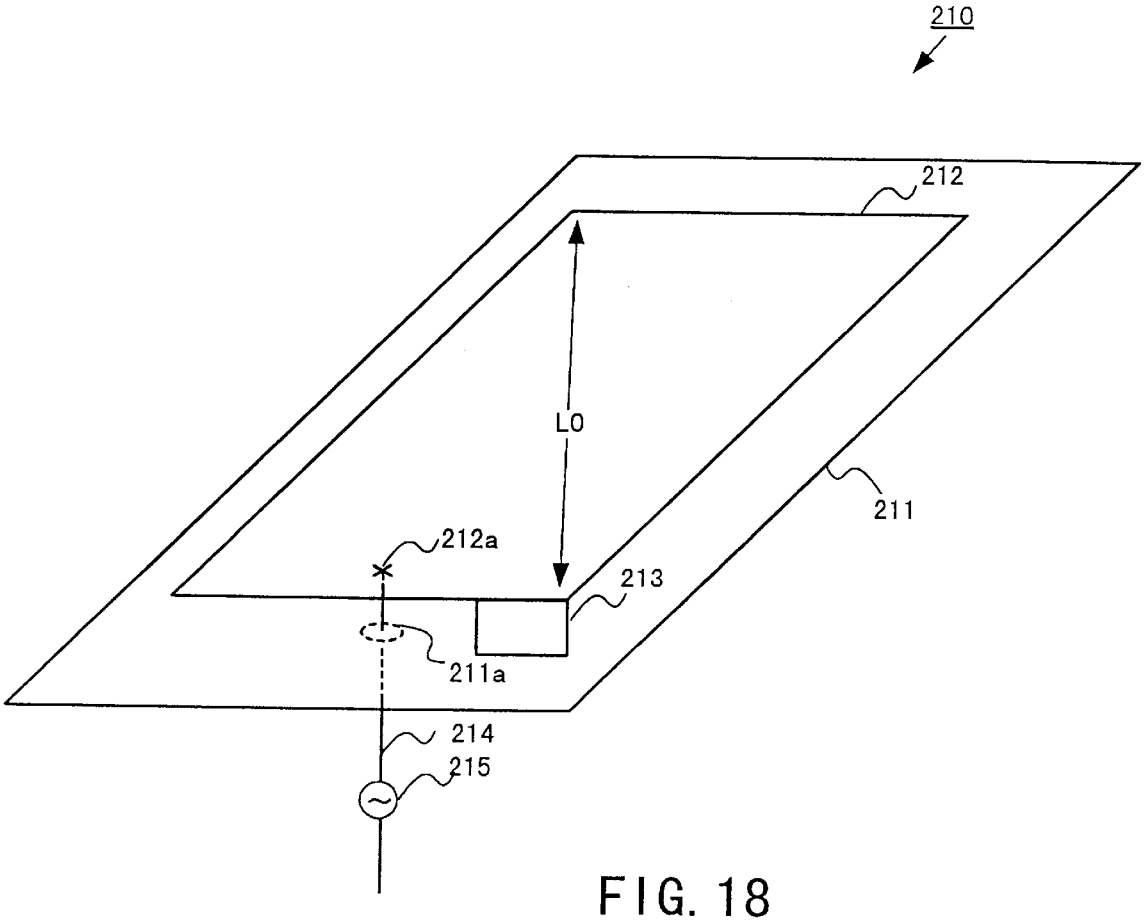
FIG. 18 Prior Art
FIG. 18 is a perspective view showing a general constitution of a conventional plane antenna with a short-circuit plate.
Figure 19:
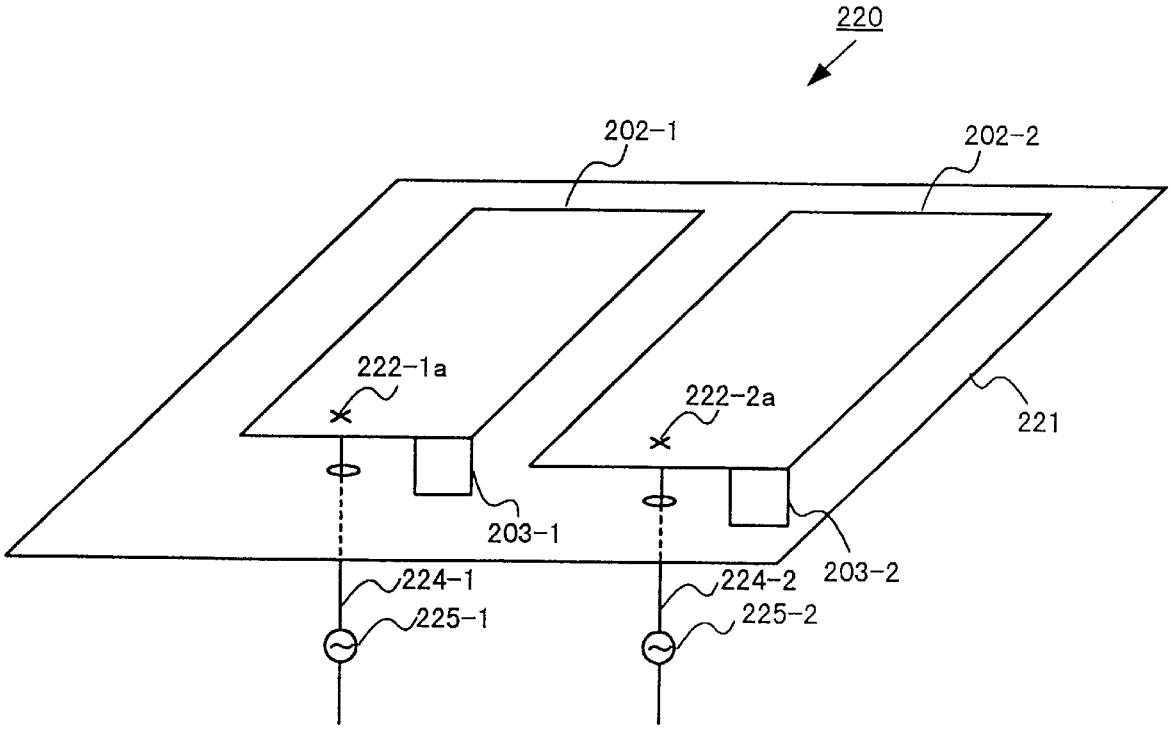
FIG. 19 Prior Art
FIG. 19 is a perspective view showing a conventional multifrequency antenna for receiving two or more different frequency bands together.
Figure 20:
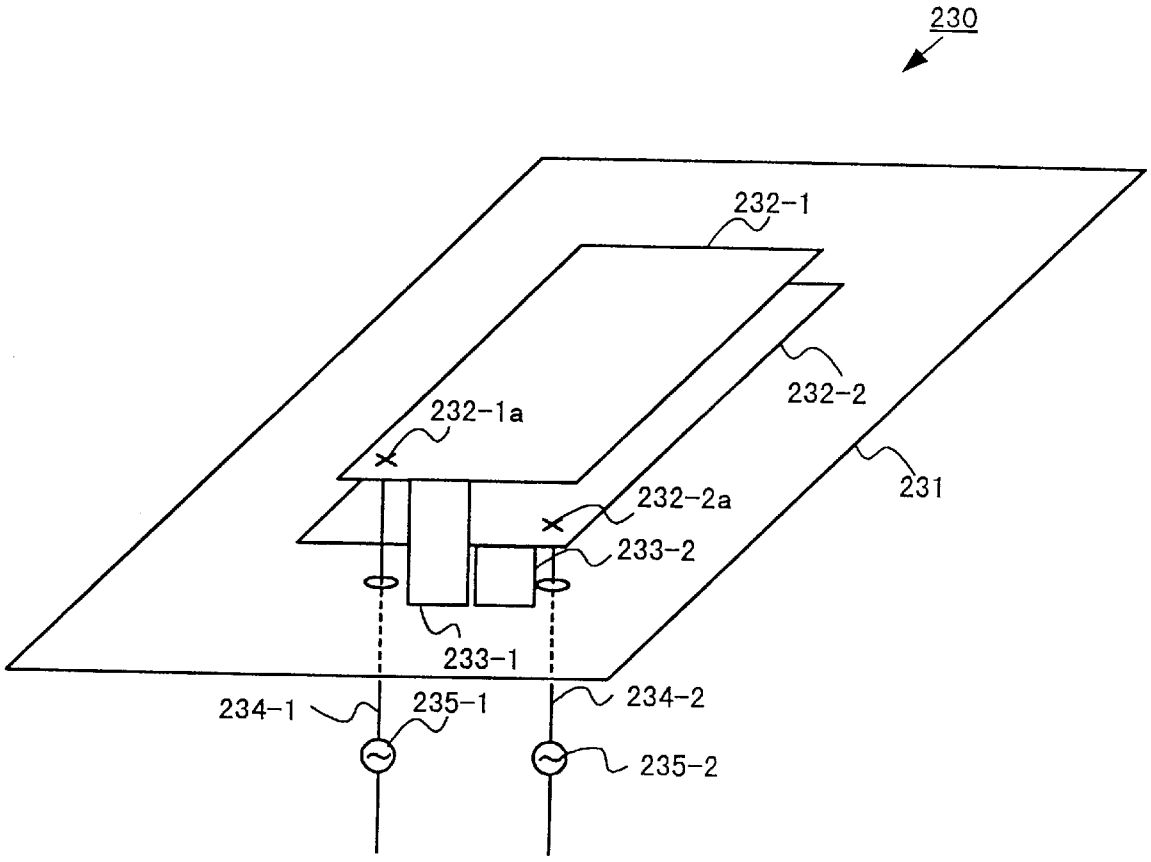
FIG. 20 Prior Art
FIG. 20 is a perspective view showing another conventional multifrequency antenna for receiving two or more different frequency bands together.

FIG. 17 is a perspective view showing the twelfth embodiment of a multifrequency antenna according to the present invention.

In a multifrequency antenna 120 of the twelfth embodiment, the shape of a radiator conductor plate 122 is set at a shape enclosed by a curve.

Namely, in FIG. 17, in the multifrequency antenna 120 of the twelfth embodiment, the radiator conductor plate 112 enclosed by a curve which is a radiator conductor is arranged on a ground plate 121 which is grounded and the radiator conductor plate 122 is connected to the ground plate 121 via a short-circuit plate 123. Power is supplied to the radiator conductor plate 122 from a power-feeding source 125 via a feeder cable 124.

In the radiator conductor plate 122, a slot 126 for shifting the 3rd mode resonance frequency to the location at a distance of L3 from the short-circuit 123 is formed.

As mentioned above, the grounding conductor of the multifrequency antenna of the present invention may use not only a rectangle but also an optional shape.

In the first to twelfth embodiments mentioned above, the multifrequency antennas using the 3rd mode resonance frequency or the 5th mode resonance frequency in addition to the main mode resonance frequency are indicated. However, according to the present invention, even if another high-order mode resonance frequency other than the 3rd mode resonance frequency or the 5th mode resonance frequency is used, the multifrequency antenna may be structured in the same way.

In this case, the cut portion (slot) to be formed in the radiator conductor plate is generally formed at least in one of the locations integer times of the distance $L=C/(2\ fn\sqrt{r})$ (where n indicates the order of an odd-order mode (n=3, 5, 7, c a light speed, fn an n-order mode resonance frequency, $\epsilon r$ a dielectric constant of a dielectric to be inserted between the radiator conductor plate and the ground plate, ($\epsilon r$) a square root of $\epsilon r$) from the short-circuit plate on the radiator conductor plate and by doing this, a multifrequency antenna for operating at least at two frequencies such as the main mode resonance frequency and at least one high-order mode resonance frequency shifted by the cut portion can be realized.

What is claimed is:

1. A multifrequency antenna comprising:

a ground plate;

a radiator conductor plate arranged opposite to the ground plate;

a short-circuit plate for connecting the ground plate and the radiator conductor plate; and power supply means for supplying power to the radiator conductor plate, wherein the radiator conductor plate includes at least one cut portion for shifting at least one high-order mode resonance frequency by a predetermined frequency, the cut portion being separated from the short-circuit plate by a predetermined distance, and the multifrequency antenna operates at least at two frequencies including a main mode resonance frequency and the at least one high-order mode resonance frequency shifted by the cut portion.

2. A multifrequency antenna according to claim 1, wherein the cut portion is formed at least in one of locations integer times of distance C/2 fn from the short-circuit plate on the radiator conductor plate, where n indicates order of an odd-order mode (n=3, 5, 7, - - - ), c a light speed, fn an n-order mode resonance frequency.

3. A multifrequency antenna according to claim 2, wherein the cut portion is a slot with a length of SL and a width of SW formed orthogonally to a current flowing on the radiator conductor plate.

4. The multifrequency antenna according to claim 2, wherein the cut portion is a hole.

5. The multifrequency antenna according to claim 2, wherein the cut portion is a cut-out portion with one end open.

6. A multifrequency antenna according to claim 2, wherein distance between the ground plate and the radiator conductor plate varies with the distance from the short-circuit plate on the radiator conductor plate.

7. A multifrequency antenna according to claim 2, wherein the cut portion is formed in the location at a predetermined distance shifted from center on the radiator conductor plate.

8. A multifrequency antenna according to claim 2, wherein the ground plate is formed in the location at a predetermined distance shifted from center on the radiator conductor plate.

9. The multifrequency antenna according to claim 1, wherein:

the multifrequency antenna includes a dielectric of a predetermined dielectric constant arranged between the ground plate and the radiator conductor plate, and the cut portion is formed at least in one of locations integer times of distance $C/(2\ fn\sqrt{\epsilon\ r})$ from the short-circuit plate on the radiator conductor plate, where n indicates order of an odd-order mode (n=3, 5, 7- - - ), c is the speed of light, fn is an n-order mode resonance frequency, and $\epsilon$ r is the dielectric constant of the dielectric.

10. A multifrequency antenna according to claim 9, wherein the dielectric is structured so that the dielectric constant varies with distance from the short-circuit plate on the radiator conductor plate.

11. A multifrequency antenna according to claim 1, wherein the power supply means supplies power to location at a predetermined distance shifted from center on the radiator conductor plate.

12. A multifrequency antenna according to claim 1, wherein the power supply means includes a coaxial line connected to the radiator conductor plate.

13. The multifrequency antenna according to claim 1, wherein the power supply means includes a coplanar line for supplying power to the radiator conductor plate by electromagnetic coupling with the radiator conductor plate.

14. A multifrequency antenna according to claim 1, wherein the power supply means includes a strip line or micro-strip line connected to the radiator conductor plate.

15. A multifrequency antenna comprising:

a ground plate;

a radiator conductor plate arranged opposite to the ground plate;

a short-circuit plate for connecting the ground plate and the radiator conductor plate, wherein the radiator conductor plate includes at least one cut portion for shifting at least one high-order mode resonance frequency by a predetermined frequency, the cut portion being separated from the short-circuit plate by a predetermined distance such that the multifrequency antenna operates at least at two frequencies including a main mode resonance frequency and the at least one high-order mode resonance frequency shifted by the cut portion; and a feeder cable and a power source for supplying power to the radiator conductor plate.

16. The multifrequency antenna of claim 15, wherein the radiator conductor plate includes a first cut portion located at a first predetermined distance from the short-circuit plate and a second cut portion located at a second predetermined distance from the short-circuit plate.

17. The multifrequency antenna of claim 15, wherein the at least one cut portion is rectangular.

18. The multifrequency antenna of claim 15, wherein the at least one cut portion is curvilinear.

19. The multifrequency antenna of claim 18, wherein the curvilinear cut portion includes an open end.

* * * * *